US005423551A

United States Patent [19]

Stavinsky

[11] Patent Number: 5,423,551

[45] Date of Patent: Jun. 13, 1995

[54] CARD GAME

[76] Inventor: Emil G. Stavinsky, 6676 Boxwood La., Las Vegas, Nev. 89103

[21] Appl. No.: 315,068

[22] Filed: Sep. 29, 1994

[51] Int. Cl.[6] ..... A63F 1/00

[52] U.S. Cl. ..... 273/306; 273/292; 273/308

[58] Field of Search ..... 273/292, 303, 306, 308, 273/243

[56] References Cited

U.S. PATENT DOCUMENTS

| | | | |
|---|---|---|---|
| 4,216,966 | 8/1980 | MacRae | 273/243 |
| 5,098,107 | 3/1992 | Boylan et al. | 273/292 |
| 5,141,235 | 8/1992 | Hernandez | 273/308 |

*Primary Examiner*—Benjamin H. Layno
*Attorney, Agent, or Firm*—Quirk & Tratos

[57] ABSTRACT

A card game for play by at least one player and a dealer is disclosed. Each player enters the game by placing an ante. Each player and the dealer also places a first bet. The dealer selects a player to start the game, and deals a first card to that player. The cards are dealt from a deck comprising two standard decks of fifty-two cards plus eighteen special cards for a total of one-hundred and twenty-two cards. If the first card received by the player is not a special card, the player remains in the game. If the player receives a special card, the player is eliminated from the game and that player's bet is passed to the next player. The dealer then deals a card to the next player, still in the game, the same determination is made as to whether the player is still in the game, and so on in succession until all but one player or the dealer has received a special card. The last player who does not receive a special card is declared the winner of the game and receives all or a part of the amounts bet by the other players.

12 Claims, 2 Drawing Sheets

CARD GAME

FIELD OF THE INVENTION

The present invention relates to a card game. In particular, the present invention relates to a card game of chance, in which players remain in the game or are eliminated based on whether they received a special card, and where the winner is the last person not to receive a special card.

BACKGROUND OF THE INVENTION

Numerous card games of skill and chance currently exist. Unfortunately, these games suffer numerous drawbacks, normally fitting into one of two categories.

The first category of card games are those which require a large amount of skill to play and/or are difficult to learn. Poker and blackjack are two very popular games which require some degree of skill to play. Because of this, while these games are quite popular, a large percentage of the population does not play them.

Inexperienced gamblers often will shy away from these games at casinos, wary of losing sums of money to experienced players simply because they do not understand the game sufficiently. Those inexperienced players who do play these card games often do not enjoy the play of the games, because they It competively. they do not possess sufficient knowledge of the game to play A second class of card games are those which are easy to learn, but are not exciting to play. For example, children often play the game of "slapjack" or "war." Neither of these games, however, provides level of the excitement necessary to be a casino type card game. Further, such games are not well suited to play by numerous players, or for wagering.

A card game is thus needed which is both extremely easy to learn and master, but which allows for wagering and is very exciting.

SUMMARY OF THE INVENTION

In accordance with the present invention, there is provided a new and improved card game which is played by from one to about eight players, plus a dealer. Preferably, the players and dealer are seated about a large table on which special areas for bets and cards are designated.

In the preferred embodiment of the present invention, each player, including the dealer, places a first bet. The first bet is preferably equal to a pre-set table amount. Once all bets are placed, the dealer preferably selects a player to start the game. The dealer then deals that player a single card, face-up.

The dealer deals the cards from a stack of cards preferably comprised of two standard decks of 52 cards, plus 18 identical special cards, for a total of 122 cards. Cards are dealt one at a time and discarded, with the cards being recombined and shuffled upon the start of every new game.

The first player receives a card from the dealer. If the card is not a special card, the player stays in the game, and the dealer deals a card to the next player. If the first player receives a special card, that player is out of the game, with his bet being passed to the next player.

Each player is dealt in succession, with the bets of players out of the game being passed successively to those still in the game, until such time as only one remaining player (or the dealer) has not received the special card. The player not receiving the special card is the winner of the game, and is entitled to winnings equal to all or at least a part of those bets placed by the other players.

In a second form of the game, each player has the opportunity to receive two special cards before being eliminated from the game. Each player may either initially place a second bet at the beginning of the game, or can place the bet after receiving a first special card, and remain in the game until a second special card is received.

As another aspect of the present game, a bonus bet may be placed by each player at the beginning of the game. If a player who placed a bonus bet successfully survives three consecutive deals of the cards without receiving the special card, that player preferably receives a bonus payout. Further, if a player successfully survives four consecutive deals of the cards without receiving the special card, that player preferably receives a jackpot. The jackpot is preferably equal to all or a portion of the bonus bets placed by all players since the jackpot was last received.

As another feature of the present invention, the dealer/house may either collect the ante for offering the game, or may take a percentage of the total winnings of a player in each game. Further, if the dealer/house wins the game, it is preferred that the house return these winnings to the next succeeding game or games until a player is the winner of the game.

Further objects, features, and advantages of the present invention will become apparent from the detailed description of the drawings which follows, when considered with the attached figures.

DETAILED DESCRIPTION OF THE PREFERRED EMBODIMENT

Figure 1:
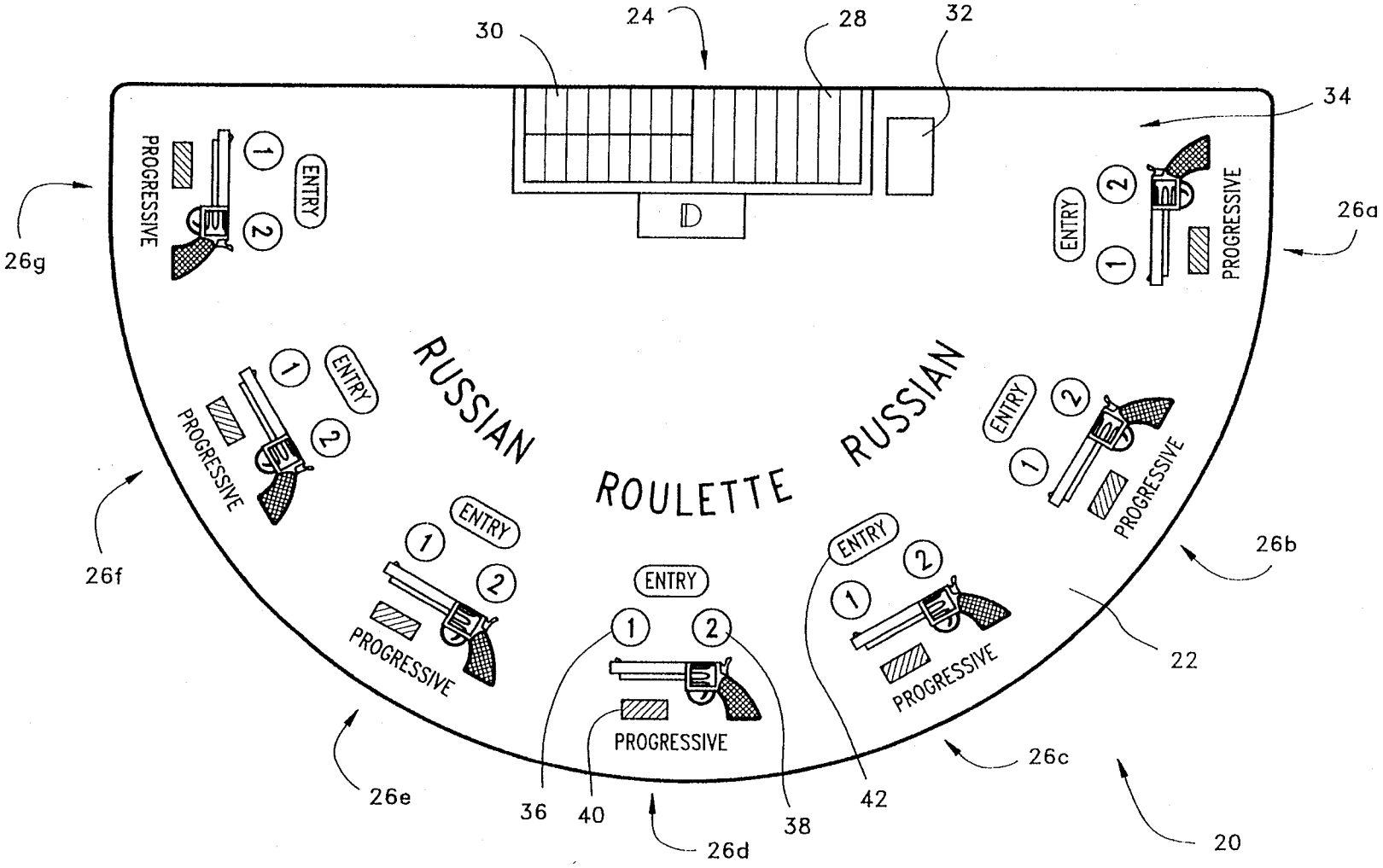
FIG. 1 illustrates a game or table layout which may be used when playing the preferred embodiment of the game of the present invention.

FIG. 1 illustrates a table layout 20 for use in playing the preferred embodiment of the game of the present invention. As illustrated, the game is preferably played at a table 22 which includes a dealer position 24 and from one to seven player positions 26*a–g*. It is contemplated that a table 22 be constructed large enough to accommodate eight or more players. As illustrated, it is preferred that the dealer position 24 be on a side of the table 22 opposite to that of the player positions 26*a–g*.

The dealer position 24 preferably includes a chip tray 28 or other area for retaining coinage, chips or other wagered items. A portion 30 of the tray 28 may be set aside for retaining the house winnings, as described in greater detail below. A card shoe 32 or other device for housing one or more cards to be dealt is located near the dealer.

Each player position 26*a–g* preferably includes an area 34 into which a card may be dealt. Further, first and second bet areas 36,38 are located in front of each player. A bonus bet area 40 is also included for each player. Lastly, a space 42 for placement of an ante or entry fee is included.

It should be understood that the above described layout 20 is merely a preferred layout for playing the preferred game of the present invention. The layout 20 may be modified in any of a number of manners for use in playing the game of the present invention. In fact, as described below, the game can be played without use of a table layout 20 at all.

The elements of the game of the present invention will now be described in conjunction with the layout 22 illustrated in FIG. 1.

Each player and the dealer places a first bet. Preferably, this bet is placed in the first bet area 36 on the layout 22. It is contemplated that the game have a "table minimum" first bet amount which each player must bet in order to continue in the game.

In one form of the game, each player, whether there be one, two, or more, must also initially place an ante in order to enter the game. For example, each player may be required to place a $1 ante in order to be entitled to play. This ante is placed on the ante entry or area 42 located on the layout.

The term "bet" and "ante" as used herein includes money, chips, token, items of value, or any other item or device which indicates that the player desires to play and which meets the approval of the other players and/or the dealer. If an ante is required, the dealer preferably collects it from each player for the house, and is not required to place one himself. On the other hand, the dealer is normally required to place the first bet in order to for the game to proceed.

Once each player has placed the first bet and the ante, if required, the dealer preferably determines who should start the game based upon the roll of one or more die. The layout may include numbered positions (not shown) in order to identify the player position 26*a–g* which corresponds to the die count. For example, if less than six players are playing, the dealer rolls a single standard six-sided die, the outcome of the die determining the player who starts the game. If more than six players are playing, a die having more than six sides are used to determine the player who starts the game.

Any of a number of means for determining the player who starts the game be used. For example, the dealer could spin a wheel, set off a random number generator, or determine the player who starts the game based on the outcome of some other random event.

The player who is selected to start the game preferably has the option of cutting the cards, or passing the cut to the next player. If the player elects to pass the cut, the next player located clockwise from the selected player cuts the cards. In the preferred embodiment, the original player selected to start the game still starts the game even though the cut was passed. In another form, the player elected to start the game can pass the cut and the right to start the game to the next player.

Figure 2:
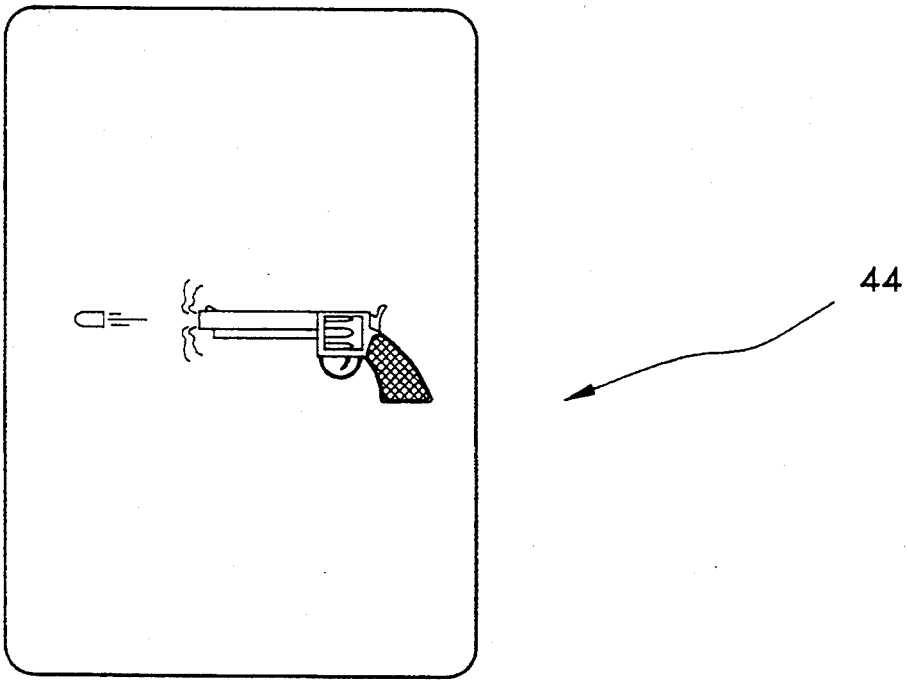
FIG. 2 illustrates the front side of a special card used in play of the game of the present invention.

Once the cards are cut, the dealer deals a card to the first player. Preferably, the dealer deals cards from a stack contained in the shoe 32, the stack comprised of two standard decks of fifty-two (52) cards (for a total of 104 cards), plus eighteen (18) unique or special cards 44 for a total of 122 cards. A preferred example of the front or playing side of one of the special cards 44 is illustrated in FIG. 2. As will become more apparent as the remainder of the game is discussed, the 104 original cards may have any value, or no value. In fact, each of these cards can all be the same, can all be different, and can even be blank. It is possible that standard decks of cards be combined to result in the 104 cards, as such decks are readily available.

As used herein, the term "deal" includes any method by which the dealer shows a card to a player. For example, the dealer may manually take a card and hand it to a player. Alternatively, the dealer might press a button which causes the image of a card to be shown on a screen by electronic or other means.

Each of the special cards 44 are "special" because each, while preferably identical to each other, are different from the other 104 standard cards. The special cards 44 should include some visual indication that the player is out of the game if the player receives the special card 44. Preferably, the special card 44 illustrates a gun being fired, as illustrated in FIG. 2. Of course, the back of the special card 44 should be indistinguishable from the backs of the other cards used in the game. Further, while it is preferred that 18 special cards 44 be used along with 104 standard cards, this number can be varied. For example, if ten players play the game, the house may desire to use 20 special cards 44 in conjunction with the 104 standard cards.

All of the cards are preferably located in the shoe 32 in front of the dealer. During the game, the dealer deals cards, one at a time, from the shoe to the card dealing area 34 at each player position 26*a–g*.

To start the game, the dealer deals a card from the shoe, face up, to the player who has been selected to start the game. If the player receives one of the special cards 44, that player is eliminated from the game, and the dealer moves the player's bet to the next player. The next player is preferably the player who is located clockwise from the first player, and who placed the required ante and bet, although it is possible to change the order of play in any fashion.

If the first player does not receive a special card 44, but instead receives one of the other cards, that player remains in the game and retains his bet. The dealer then moves to the next player and deals a card face-up in front of the next player.

Once again, if the player receives the special card 44, that player is eliminated from the game, and the dealer moves his bet and any previously lost bets to the next player. If that player does not receive a special card, the dealer moves the "pot," consisting of lost bets, to the next player. Preferably, the "next player" is again that player located clockwise from the last player dealt to and who originally paid the ante and first bet and who has not yet been eliminated from the game.

Play continues as described above, with the dealer dealing a card to each player and himself, until all but one player has received a special card 44. This player is the winner of the game. Because of the movement of the bets as each player and the dealer receive a special card 44, the last player in the game is entitled to all of the monies and bets of the other players/dealers.

After the winner of the game is declared, the dealer announces the start of a new game. At that time, each player places an ante and first bet and the process begins again.

In a preferred alternate aspect of the present invention, each player (and the dealer) is entitled to place a second bet. The second bet is placed in the second bet area 38 on the table 22 at the same time the first bet is placed. Preferably, the second bet is equal in value to the first bet, with both bets being equal to a preset table amount. The second bet can be more or less than the first bet.

In this alternate embodiment, if a player places a second bet, the player has the opportunity to receive two special cards 44 before he is eliminated from the game. For example, a player placing a second bet who receives a first special card 44 remains in the game. If that player receives a second special card 44 later in the game, that player is then eliminated from the game. If, on the other hand, the player never receives either a first or a second special card 44, that player wins the game.

In a second alternate form of the game of the present invention, each player and the dealer who has placed only a first bet (and not the second), has the opportunity to remain in the game if that player places a second bet at the time he receives a first special card. The player or dealer only has one opportunity to re-enter the game in this, fashion, however, and after the player receives a second special card, the player is eliminated from the game.

As one embodiment of the present invention, the dealer (e.g. house) receives a certain percentage or amount for providing the dealing services and the table for play. In particular, if there is only a single player playing against the dealer/house, no entry ante should be required. In this case, the house and single player play against one another based solely on the first and/or second bets placed, with the winner of each game receiving the total amounts wagered.

If there are two players and a dealer, an entry ante may be required and collected by the dealer/house, with the dealer/house taking no commission from the winnings of the game based on the first and second bets placed.

Lastly, where there are three or more players and the dealer playing the game, it is preferred that the dealer/-house collect each ante if one is required, and take a commission based on the winnings of each game. In particular, the dealer/house may collect about five to forty percent (5–40%), and preferably ten percent (10%) of the winnings of each game. After the winner of the game is declared, the dealer collects the commission for the house and returns the remainder of the winnings to the winning player.

As used herein, the term winnings means the total of all first and second bets placed by the player(s) and dealer. As described above, as the game progresses, the bets are added to the pot as each player is eliminated, with the pot moving from player to player as the cards are dealt.

In this embodiment, if the dealer/house wins the game, one of two options occur. First, the dealer/house may retain the entire winnings. Second, and alternatively, if the dealer/house wins a game, the dealer/-house returns the winnings to the "pot" in the next game, such that the winnings in the next game are substantially increased. The dealer/house continues to return the winnings of all games until a player wins the game, when the dealer/house preferably collects a commission of ten to forty percent (10–40%), and most preferably thirty percent (30%), with the player retaining the remaining accumulated amounts.

In yet another aspect of the present invention, each player is entitled to place a bonus bet. In this version of the game, each player desiring to participate in a bonus places a bonus bet in the bonus or progressive area 40 on the table 22. This bet may be of any amount, although amounts between $1 and $10 are preferred. In this form of the game, if a player successfully avoids receiving the special card 44 after three successive deals, that player is entitled to receive a bonus payout. If a player is able to avoid receiving the special card 44 after four successive deals, that player is entitled to receive an even larger bonus payout or jackpot. The jackpot may, for example, comprise all or a part of all bonus bets placed by all players since the time the jackpot was last awarded.

Then the bonus bet is employed, the dealer deals a card to each player position, regardless of whether a player is playing at each position. For example, if two players (of seven playing positions) are playing against the dealer, it is preferred that the dealer deal all seven positions, to properly distribute the cards dealt.

It is preferred that the game be played on a table 22, as described above, but the game of the present invention can be played in other formats. For example, the game can be played in video or other electronic format. In such a format the players may sit in front of one or more video screens displaying dealt cards. The cards can be actual cards dealt which are shown via camera onto a screen, or electronically produced cards "dealt" by a computer, as described above. The cards are shown on the screen as they are dealt to each player, with the rules of the game remaining the same as described above.

In the form just described, the game may be produced as a television game show. In this form, a number of players are selected to come onto a stage and play the game in front of a large video screen. Each player places bets from an amount the "house" has credited to them. The winner of the game, i.e. the person who does not receive the special card 44, is entitled to the monies bet by the other players, plus other cash and prizes awarded by the operators of the show.

In another form of the form of the game, when played as a game show type game, contestants are allowed to answer a question or do some other act in order to remain in the game if they receive the special card 44. For example, if a player receives the special card 44, that player might be asked a complex trivia question. If the player successfully answers the question, the player is granted a reprieve and allowed to remain in the game.

The above described arrangements of apparatus and the method(s) of playing the games therewith are merely illustrative of applications of the principles of this invention and many other embodiments and modifications may be made without departing from the spirit and scope of the invention as defined in the claims.

I claim:

1. A method of playing a card game played by a plurality of players using a plurality of cards which include at least one special card comprising:

each player placing a first bet;

dealing a card to each player in succession;

determining whether each player received a special card;

eliminating said player from said game if a special card is received;

allowing said player to remain in said game if a special card is not received;

continuing to deal a card to each player remaining in said game until all but one player is eliminated; and declaring the last player not receiving a special card to be the winner of the game.

2. The method of claim 1, further comprising the step of each player placing an ante.

3. The method of claim 2, further comprising the step of the dealer collecting the ante.

4. The method of claim 1, further comprising the step of allowing each player to place a second bet, and wherein said player is eliminated from said game upon receipt of a second special card.

5. The method of claim 4, wherein said each player is entitled to place said second bet when said first bet is placed, or after receiving a first special card.

6. The method of claim 1, further comprising the step of allowing each player to place a bonus bet.

7. The method of claim 6, further comprising the step of awarding a bonus payout to each player who placed said bonus bet and who did not receive a special card in three consecutive deals in the same game.

8. The method of claim 6, further comprising the step of awarding a jackpot to each player who placed said bonus bet and who did not receive a special card in four consecutive deals in the same game.

9. The method of claim 8, wherein said jackpot is all or part of all bonus bets placed since the last jackpot was awarded.

10. The method of claim 1, further including the step of awarding the winner of the game winnings of at least a portion of the bets placed by all players.

11. The method of claim 10, wherein the dealer collects a commission of all bets placed before said winner is awarded said winnings.

12. The method of claim 1, further including the step of returning all bets placed to the next game if said dealer is declared the winner.

one hundred and four cards; and from 10 to 30 identical special cards.

* * * * *